US006913564B2

(12) United States Patent
Inoue et al.

(10) Patent No.: US 6,913,564 B2
(45) Date of Patent: Jul. 5, 2005

(54) TRAINING APPARATUS

(75) Inventors: Takeshi Inoue, Saitama (JP); Masao Seimiya, Saitama (JP); Junichi Watanuki, Saitama (JP)

(73) Assignee: Combi Corporation, Saitama (JP)

( * ) Notice: Subject to any disclaimer, the term of this patent is extended or adjusted under 35 U.S.C. 154(b) by 375 days.

(21) Appl. No.: 10/167,167

(22) Filed: Jun. 11, 2002

(65) Prior Publication Data

US 2002/0193208 A1 Dec. 19, 2002

(30) Foreign Application Priority Data

Jun. 12, 2001 (JP) ..... 2001-177754
Jun. 12, 2001 (JP) ..... 2001-177755
Jun. 12, 2001 (JP) ..... 2001-177756
Jun. 12, 2001 (JP) ..... 2001-177757
Jun. 12, 2001 (JP) ..... 2001-177758

(51) Int. Cl.[7] ..... A63B 21/00
(52) U.S. Cl. ..... 482/57
(58) Field of Search ..... 482/51–54

(56) References Cited

U.S. PATENT DOCUMENTS 4,678,182 A * 7/1987 Nakao et al. ..... 482/9
4,805,901 A * 2/1989 Kulick ..... 482/63
5,267,925 A * 12/1993 Boyd ..... 482/64
6,042,518 A * 3/2000 Hildebrandt et al. ..... 482/57
6,084,325 A * 7/2000 Hsu ..... 310/74

* cited by examiner

*Primary Examiner*—Stephen R. Crow
(74) *Attorney, Agent, or Firm*—Koda & Androlia

(57) ABSTRACT

The present invention relates to a training apparatus which make a convenient assembly be carried out from one direction and respective parts be placed on both supporting plates as a unit, wherein a pair of supporting plates 13, 14 fixed to the main body frame 2 are provided, only one 13 of the supporting plates is formed so as to pass through the space defined by said main body frame 2 and saddle post 5, and the crank shaft 17 and the shaft of the loading device are supported by at least one of said pair of supporting plates 13, 14.

2 Claims, 19 Drawing Sheets

TRAINING APPARATUS

TECHNICAL FIELD OF THE INVENTION

This invention relates to a training apparatus which is a bicycle-type health improvement equipment, in particular, to a training apparatus provided with a highly shock-resistant loading device.

BACKGROUND OF THE INVENTION

Typically, this kind of training apparatus has a handle to grip with both hands and a saddle to sit on, and is for training the legs and loins by working the pedals while sitting on the saddle and gripping the handle.

For this reason, the training apparatus is provided with a loading device such as an electromagnetic brake to apply a load when working the pedals. Therefore, an annular drive transmission member such as a pulley or sprocket is connected to the pedals through a crank shaft. While a shaft of said loading device is also provided with an annular driven transmission member such as a pulley or sprocket, and a running type drive transmission member such as a belt or chain is wound around this annular drive transmission member and annular driven transmission member. Therefore, when the pedals are worked, the rotation of the pedals is transmitted to the loading device. Since this loading device generates braking torque, accordingly load from the loading device is applied to the pedal.

In a conventional training apparatus, the shaft of said loading device is inserted through the stay having an opening, which is cut in a U-shape on the fixing side in order to prevent the shaft itself of the loading device from rotating, and the shaft is fixed by firmly tightening the opening with a bolt and nut.

However, in this conventional configuration, the opening is expanded by a shock when transported. As a result, the shaft might not be stably supported.

SUMMARY AND OBJECT OF THE INVENTION

It is an objective of the invention to overcome the problems in the conventional apparatus and to provide a training apparatus equipped with a highly shock resistant loading device.

In order to achieve the above-mentioned objective, the training apparatus of the invention is characterized in that a pair of supporting plates are provided, bearings are arranged on the respective supporting plates, and the rotor shaft fixing said rotor is rotatably supported by these bearings.

In order to achieve the above-mentioned objective, the training apparatus of the invention is characterized in that a pair of supporting plates fixed to the main body frame are provided, and only one of the supporting plates is formed so as to pass through the space defined by said main body frame and saddle post, and the crank shaft and the shaft of the loading device are supported by at least one of said pair of supporting plates. Employment of this arrangement allows one of the supporting plates to pass through said space, therefore, convenient assembly can be carried out from one direction and respective parts can be placed on both supporting plates as a unit, thereby, assembly inspection can be carried out at locations other than an assembly line.

The training apparatus of the invention is further characterized in that the tension applying arm which is rotatable and applying tension to the running type drive transmission member by applying force with a spring is located so that the rotating center of the arm is positioned at an intermediate position between said crank shaft and the rotor shaft, and the roller provided on the tension applying arm, in a pressed manner, comes into contact with said running type drive transmission member. Employment of this arrangement allows for compact arrangement and automatic application of proper tension to the running type drive transmission member.

The training apparatus of the invention is still further characterized in that a pair of supporting plates fixed to the main body frame are provided, only one of the supporting plates is formed so as to pass through the space defined by said main body frame and saddle post, and the crank shaft and the shaft of the loading device are supported by at least one of said pair of supporting plates. Employment of this arrangement allows one of the supporting plates to pass through said space, therefore, convenient assembly can be made from one direction and respective parts can be placed on both supporting plates as a unit; thereby assembly inspection can be carried out at locations other than an assembly line.

The training apparatus of the invention is also characterized in that the annular drive transmission member is located in the vicinity of the supporting plate which cannot pass through the space from the loading device. Employment of this arrangement allows the annular drive transmission member to be primarily supported by a large supporting plate with high rigidity which cannot pass through the space, thereby stably supporting the annular drive transmission member.

The training apparatus of the invention is additionally characterized in that a pair of supporting plates is provided, bearings are located on the respective supporting plates, and the rotor shaft fixing said rotor is rotatably supported by these bearings. Further, a stator is fixed to one of the supporting plates, and then the rotor shaft is freely inserted into the penetrating hole formed on this stator. Employment of this arrangement allows the rotor and stator to be easily positioned; therefore, the positions of the rotor and stator can be easily controlled.

The training apparatus of the invention is characterized in that the crank shaft and rotor shaft are connected by a one-stage running type drive transmission member. Employment of this arrangement allows the arrangement to be simplified and to be compact.

PREFERRED EMBODIMENTS OF THE INVENTION

Figure 1:
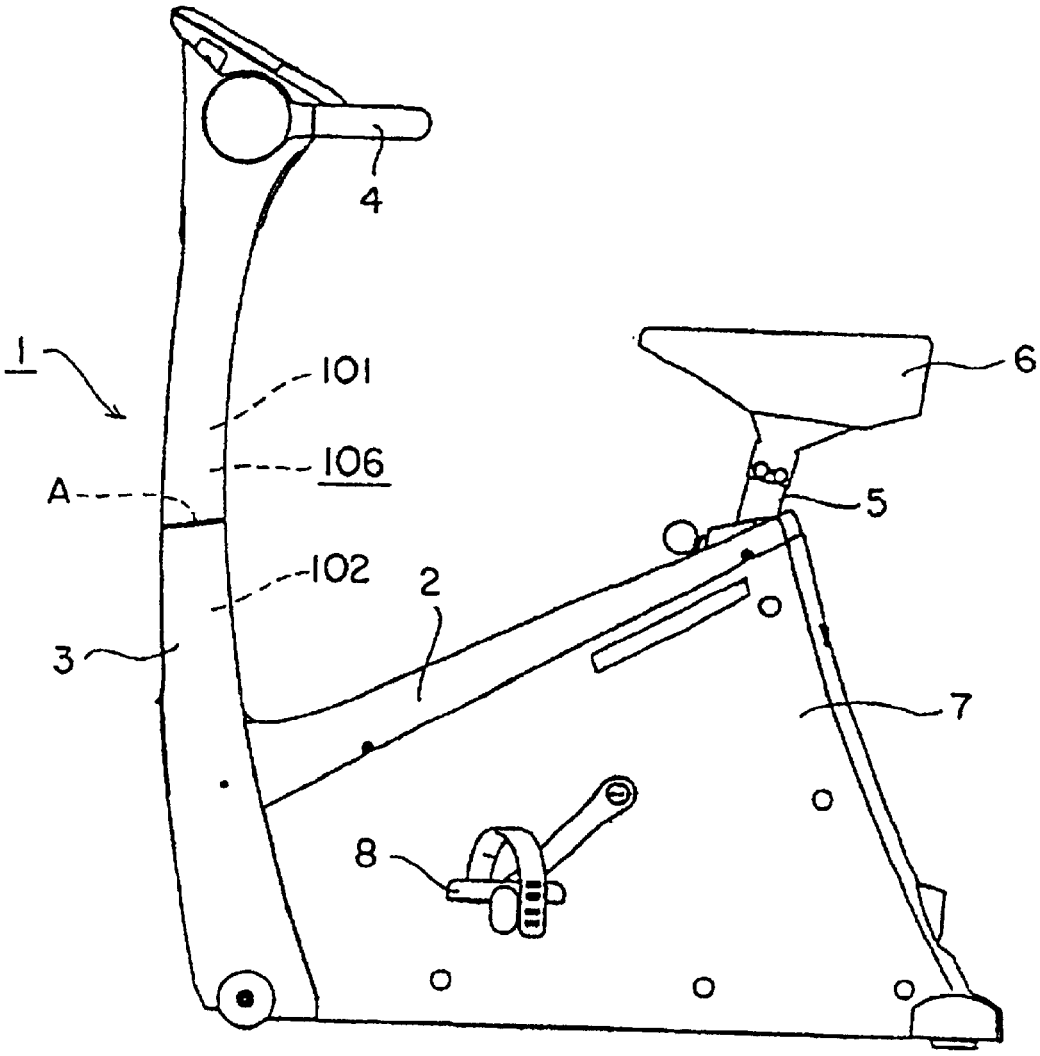
FIG. 1 is a left side view showing an embodiment of the training apparatus according to the invention.
Figure 2:
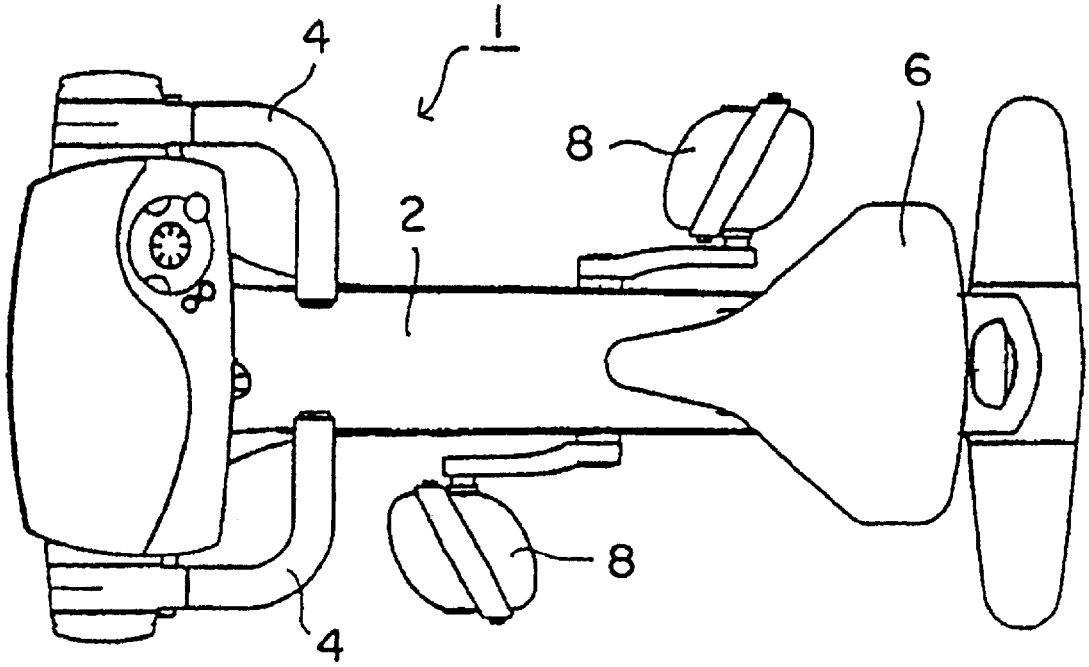
FIG. 2 is a plan view of FIG. 1.

FIG. 1 and FIG. 2 show an external appearance of the training apparatus to which a loading device according to the present invention is applied. In these figures, on the front of the metallic main body frame 2 of the training apparatus 1, a pair of handle posts 3 are provided in parallel at a predetermined interval so as to be perpendicular to the paper surface in FIG. 1. The handle 4 which the user grips when using the apparatus is supported on the respective handle posts 3. Further, a saddle 6 to sit on is supported on the rear of said main body frame 2 via a saddle post 5. Both sides of said main body frame 2 are covered with exterior covers 7 made from plastic, and pedals 8 are located so that they are projected to the outside of respective exterior covers 7.

Figure 3:
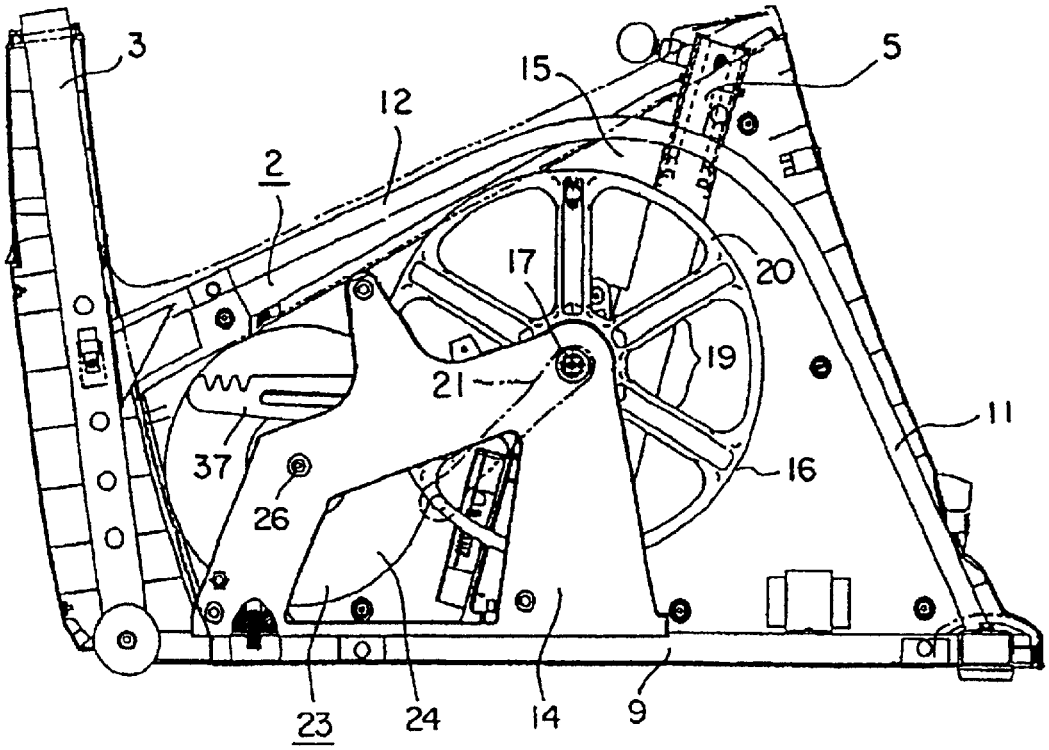
FIG. 3 is an enlarged left side view of the primary part for which the exterior cover of FIG. 1 is omitted.
Figure 4:
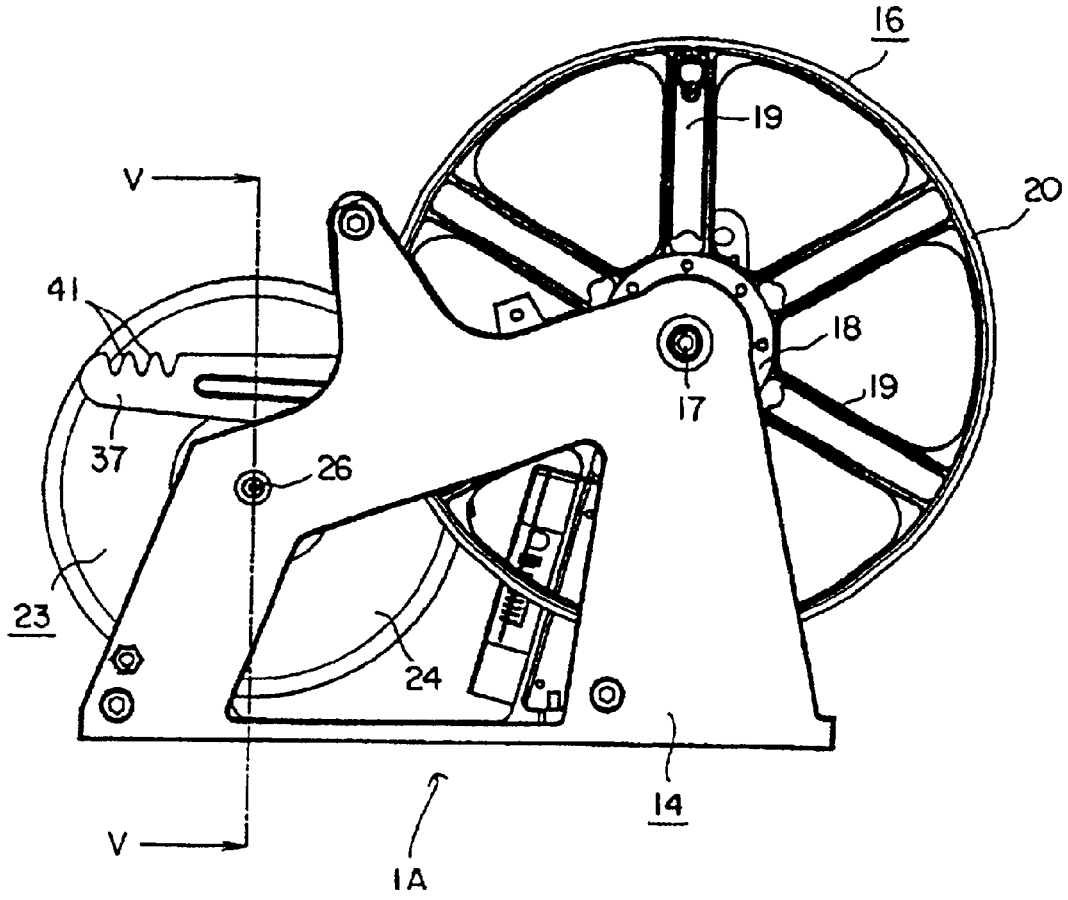
FIG. 4 is an enlarged left side view of the drive unit which is a primary part in FIG. 1.
Figure 5:
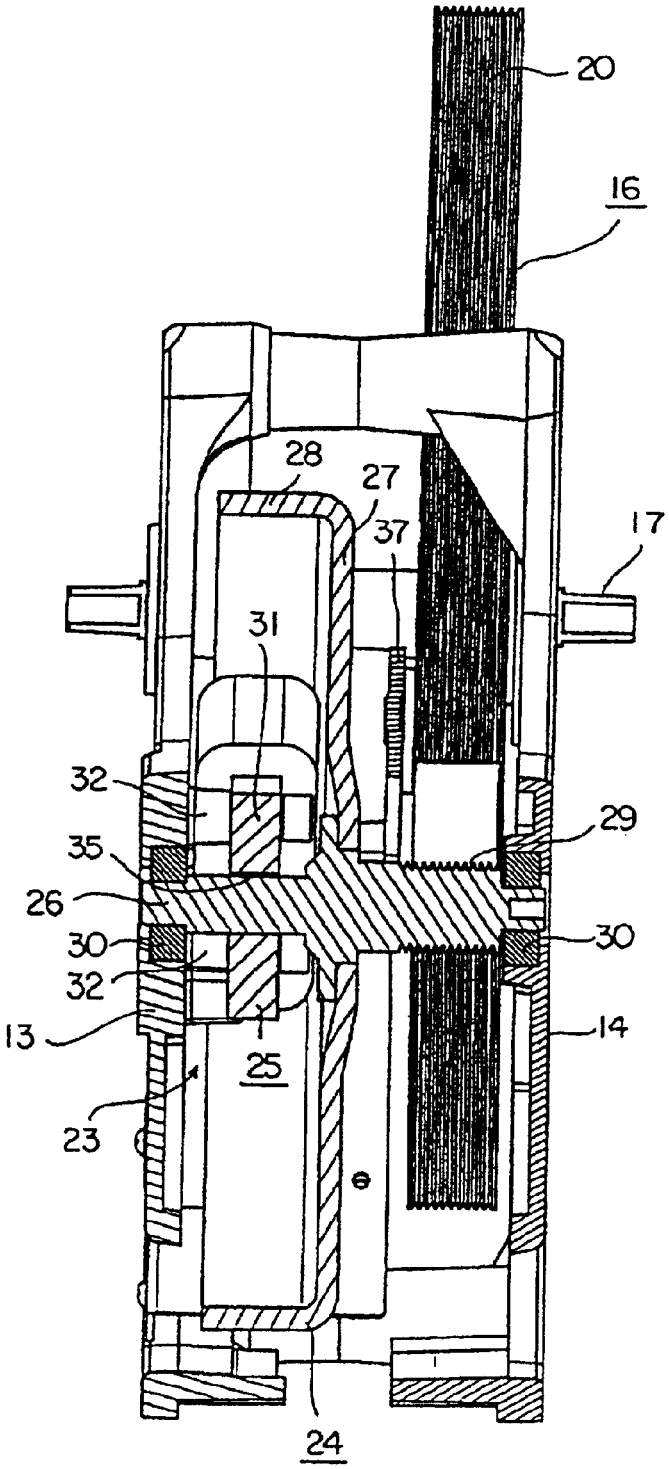
FIG. 5 is a vertical cross-sectional view along V—V line in FIG. 4.

FIG. 3 through FIG. 6 show primary portions of said training apparatus 1. FIG. 4 shows a drive unit 1A which is a more detailed primary portion of said training apparatus 1. Said main body frame 2 is formed in a trapezoid shape as a whole. Said main body frame 2 has a lower frame 9 positioned on the lower part located in parallel. Said handle post 3, whose upper part is inclined and located so as to project forward, is connected to the front end of this lower frame 9, and a rear frame 11 which is shorter than said handle post 3 and whose upper part is inclined and located so as to project forward is connected to the rear end of said lower frame 9.

Further, the upper frame 12 which is inclined and located so that the front portion is positioned at the lower part bridges and is connected, respectively, between said handle post 10 and the top end of the rear frame 11. In this embodiment, said rear frame 11 and upper frame 12 are constructed of an integral pipe whose intermediate portion is bent.

Said saddle post 5 is inclined and is supported in the middle between the connecting portion of said rear frame 11 and said upper frame 12, and said lower frame 9.

Figure 6:
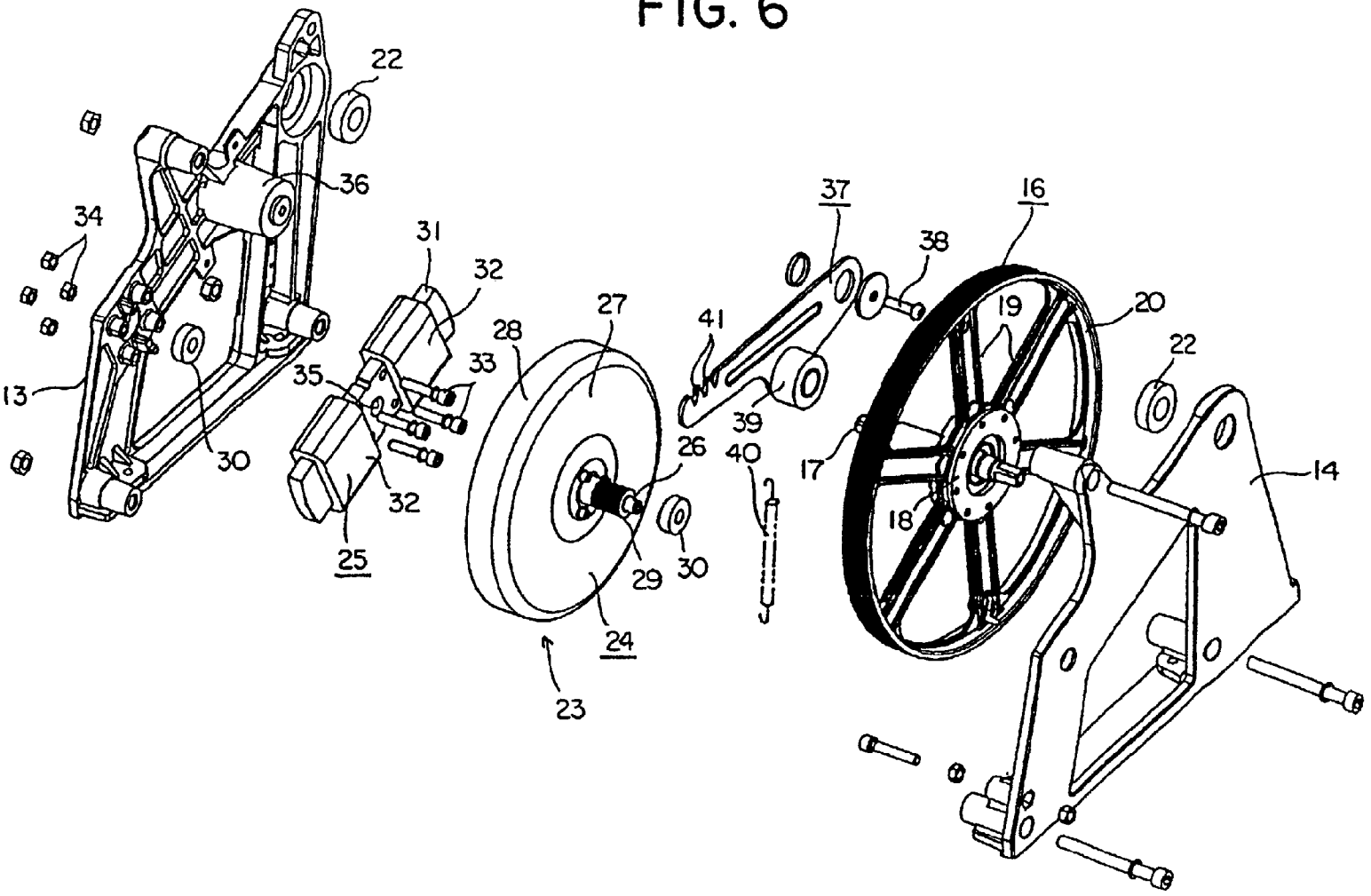
FIG. 6 is a disassembly perspective view of FIG. 4.

As shown in greater detail in FIG. 6, a pair of supporting plates 13 and 14 made of metal, such as aluminum, is fixed to said main body frame 2. One supporting plate 13 among this pair of supporting plates 13 and 14 is shaped so as to pass through the space 15 defined by said lower frame 9 of said saddle post 5 and said main body frame 2, handle post 3 and upper frame 12. The other supporting plate 14 is larger than said supporting plate 13 and cannot pass through said space 15.

A pulley 16, an example of an annular drive transmitted member, is supported by said both supporting plates 13 and 14 and has a boss 18 fitted into the outer circumference of the crank shaft 17 positioned in the center. Six arms 19 protrude outwardly to extend in a radial direction from this boss 18 at an interval of 60°. An annular rim 20 is fixed to the outer circumference of said arms 19, respectively.

Said crank shaft 17 is connected to said pedals 8 via crank arm 21 shown by the imaginary line in FIG. 3, and the entirety of said pulley 16 synchronously rotates via the crank shaft 17 by working these pedals 8. Both ends of said crank shaft 17 are rotatably supported by respective top end portions of said both supporting plates 13 and 14 via bearings 22, respectively.

As an example of a loading device applying a load when working said pedals, an electromagnetic brake 23, which is constructed by rotor 24 and stator 25, is arranged in the vicinity of said pulley 16. In said rotor 24 among these, the rotor main body 27 is fixed to the outer circumference of the rotor shaft 26 located in the center by a number of bolts not shown, and the annular rotor flange 28 is provided at the outer circumference of this rotor main body 27. A pulley 29 whose diameter is slightly larger than that of the rotor shaft 26 and much smaller than that of said rim 20 is fitted on said rotor shaft 26 at the extension of the rim 20 of said pulley 16 in the diametrical direction. Both ends of said rotor shaft 26 are rotatably supported on the other top ends of said both supporting plates 13 and 14 via bearings 30, respectively.

On the other hand, the stator 25 of said electromagnetic brake 23 has a flat rectangular solid stator main body 31 located in said rotor main body 27 and rotor flange 28 with a space, and multiple coils 32 are wound on this stator main body 31 at two portions separated by space in the diameter direction of said rotor main body 27. Also, said stator main body 31 is fixed on the other top of said supporting plate 13, respectively, with a number of bolts 33 and nuts 34. Said rotor shaft 26 is inserted through the penetrating hole 35 bored in the middle in the longitudinal direction of said stator main body 31. Therefore, magnetic flux in the direction to constrain the rotation of said rotor 24 is generated by the flowing current to said respective multiple coils 32.

As an example of a running type drive transmission member, a belt is wound around the rim 20 with the larger diameter of said pulley 16 and pulley 29 with the smaller diameter of said electromagnetic brake 23. Thus, if the crank shaft 17 is rotated by working both pedals 8 by foot, the pulley 16 is also rotated by rotation of the crank shaft 17, and the rotation of the pulley 16 is transmitted to the pulley 29 of the electromagnetic brake 23 through the belt. For the rotor shaft 26 integrated with the pulley 16, the rotor 24 receives force to constrain its rotation by the current flowing in respective multiple coils 32, and the load is transmitted to the pulley 16 and pedal 18 through the belt. As a result, the force required to work the respective pedals 8 increases, and the muscle is strengthened.

Pedestal 36 is provided in a protruding manner in the middle between both bearings 22 and 23 of said supporting plate 13, and one end of the tension applying arm 37 for applying tension to said belt is rotatably pivoted on this pedestal 36 with screws 38.

A roller 39, which, in a pressed manner, comes into contact with said belt, is rotatably supported in the middle of the longitudinal direction of said tension applying arm 37, and a plurality of spring engaging portions 41 to engage coil spring 40 for applying tension to the tension applying arm 37 is formed on the other end of the tension applying arm 37. Further, the other end of said coil spring 40 not shown is held by the lower frame 9 of said main body frame 2.

The drive unit 1A, as shown in FIG. 4, includes said supporting plates 13 and 14, the pulley 16 supported on these supporting plates 13 and 14, electromagnetic brake 23 and tension applying arm 37.

According to the above-described arrangement, the bearings 30 supporting the rotor shaft 26 are arranged on respective supporting plates 13 and 14 in a state where the rotor 26 itself can rotate, therefore, durability of the bearings 30 is secured by using the respective bearings 30 of sufficiently large size. Also, the outer diameter of the pulley 29 fitted into the rotor shaft 26 is made much smaller, and thereby a sufficient speed change ratio can be secured by only one shift in the speed change. As a result, the arrangement becomes simplified.

In the loading device of the conventional training apparatus, the stator is pressed into the shaft and the rotor is rotatably supported on this shaft via bearings; however, in such an arrangement, there exists a problem in that a difference in position of the stator on the shaft is generated depending on the pressing force of the stator. Therefore, it is difficult to control the position.

However, in this embodiment, it is easy to control the positions of the rotor 24 and stator 25 because the stator 25 is fixed to the supporting plate 13 and the rotor 24 is freely inserted into the penetrating hole 35 of the stator 25.

Additionally, the pedestal 36 of the supporting plate 13, to which the screw 38 rotatably supporting the tension applying arm is screwed, is provided in the middle between both bearings 22 and 30 which are provided on the supporting plate 13. As a result, a compact arrangement of the supporting plate 13 is allowed and the supporting plate 13 is allowed to pass through said space 15. Further, resilient force of the coil spring 40 can work sufficiently, and suitable tension is applied to the belt because the roller 39 of the tension applying arm 37, which, in a pressed manner, comes into contact with the belt (not shown), is wound around both pulleys 16 and 29 from generally the right direction.

Furthermore, in the conventional training apparatus, respective parts are built into and fixed from both sides of the main body frame; therefore, at least two workers are required to assemble the training apparatus and workability is poor. In addition, respective parts were attempted to be directly assembled to the main body frame, thereby causing a problem in that a long assembly line was required in the mass production process.

However, in this embodiment, one supporting plate 13 is shaped so as to pass through the space 15 defined by the said lower frame 9 of the saddle post 5 and main body frame 2, handle post 3 and upper frame 12. Therefore, there is no need to assemble respective parts into the apparatus and fix them. Therefore, assembly can be made from one side by tilting the drive unit 1A, assembly of the training apparatus 1 can be made by only one worker, and, as a result, workability is enhanced.

Furthermore, the work required is for only fixing the drive unit 1A, to which respective parts are directly assembled, to the main body frame 2. Therefore, the mass production process requires a shorter assembly line, productivity is enhanced compared to the conventional lines, the drive unit 1A can be inspected at locations other than assembly line, and therefore inspections such as the electromagnetic brake 23 can be simply carried out.

Further, the heavy pulley 16 with a large diameter is arranged in the vicinity of the supporting plate 14 which cannot pass through said space 15 because of its shape and has higher rigidity than that of the other supporting plate 13. Therefore, the pulley 16 can be stably supported.

The training apparatus 1 according to the embodiment has a handle rotating mechanism 62 as a position adjusting mechanism for said handle 4 shown in FIG. 7 through FIG. 15.

Figure 7:
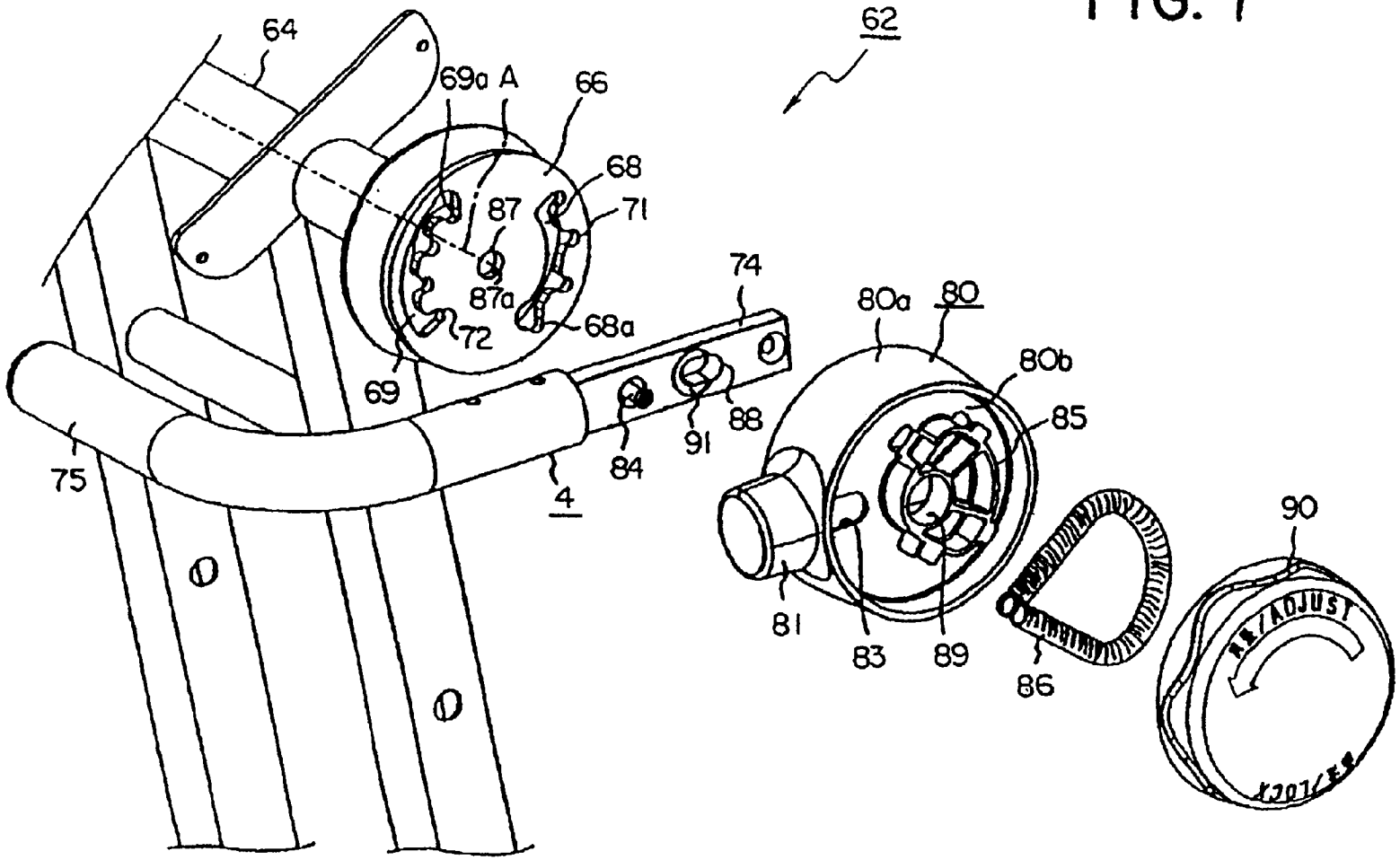
FIG. 7 is a disassembly perspective view showing the right side handle rotating mechanism in an embodiment of the handle rotating mechanism according to this invention as an example of the position adjusting mechanism of the lever according to this invention.
Figure 8:
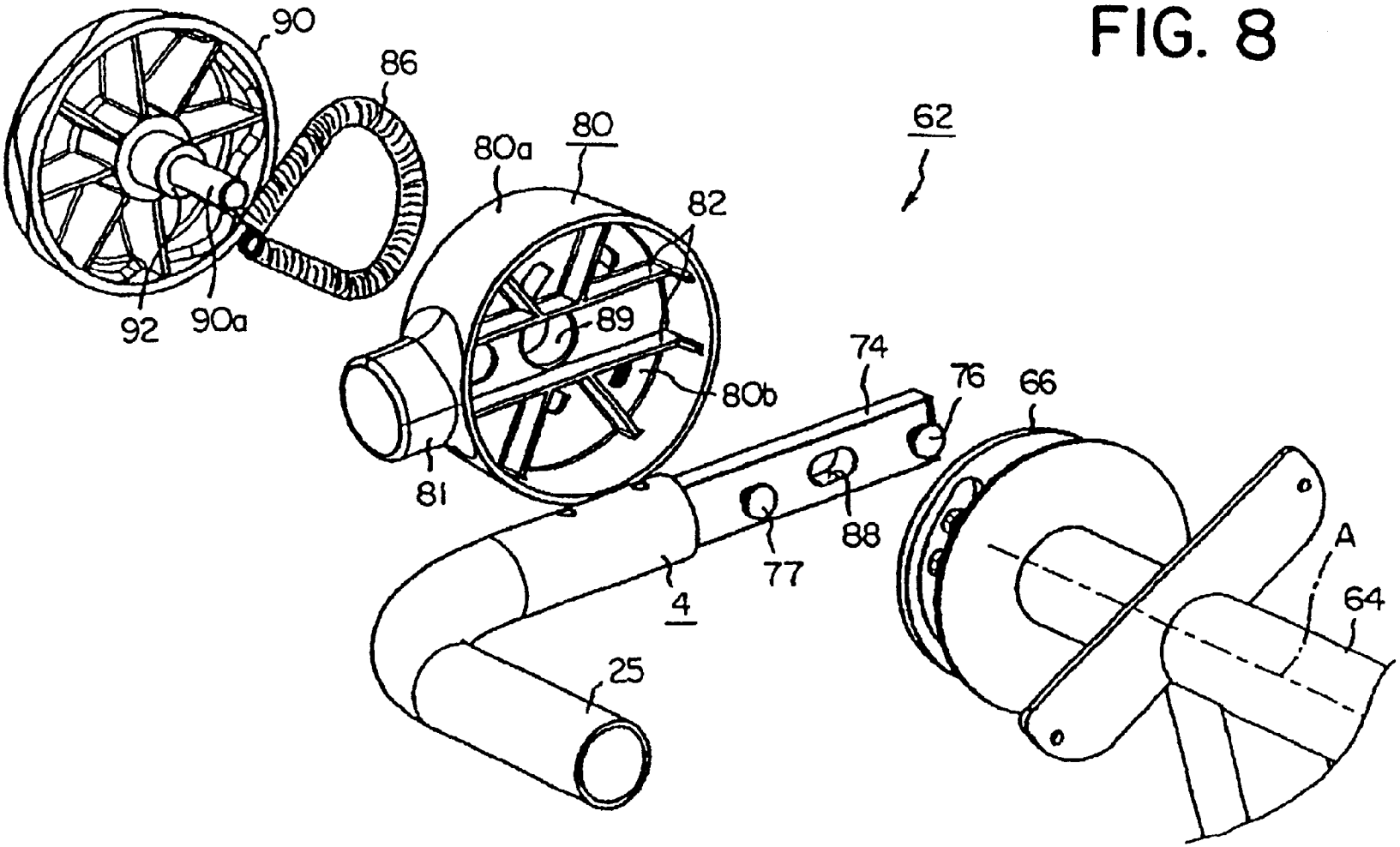
FIG. 8 is a disassembly perspective view showing the left side handle rotating mechanism in an embodiment of the handle rotating mechanism according to this invention as an example of the position adjusting mechanism of the lever according to this invention.

As shown in FIG. 7 and FIG. 8, said handle rotating mechanism 62 has a handle mounting portion 64 in a generally cylindrical shape extending horizontally on one end of the handle post 3, and a pair of handle holding plates 66 in a disk shape as a lever holding plates are secured concentric with said handle mounting portion 64 on both side end faces of this handle mounting portion 64.

A pair of rotation holding grooves 68 and 69 in a generally arc shape so as to be concentric with said handle mounting portion 64 are formed so that they sandwich the center axis of the handle holding plate 66 and face each other, and rotation of the handle 4 which uses the center axis A of said handle holding plate 66 as a rotating axis is held by this pair of rotation holding grooves 68 and 69. Therein, one rotation holding groove 68 among a pair of rotation holding grooves 68 and 69 which is on the front side of the handle post 3 is assumed to be a first rotation holding groove 68, and the other, on the rear side of the handle post 3, is assumed to be a second rotation holding groove 69.

Figure 9:
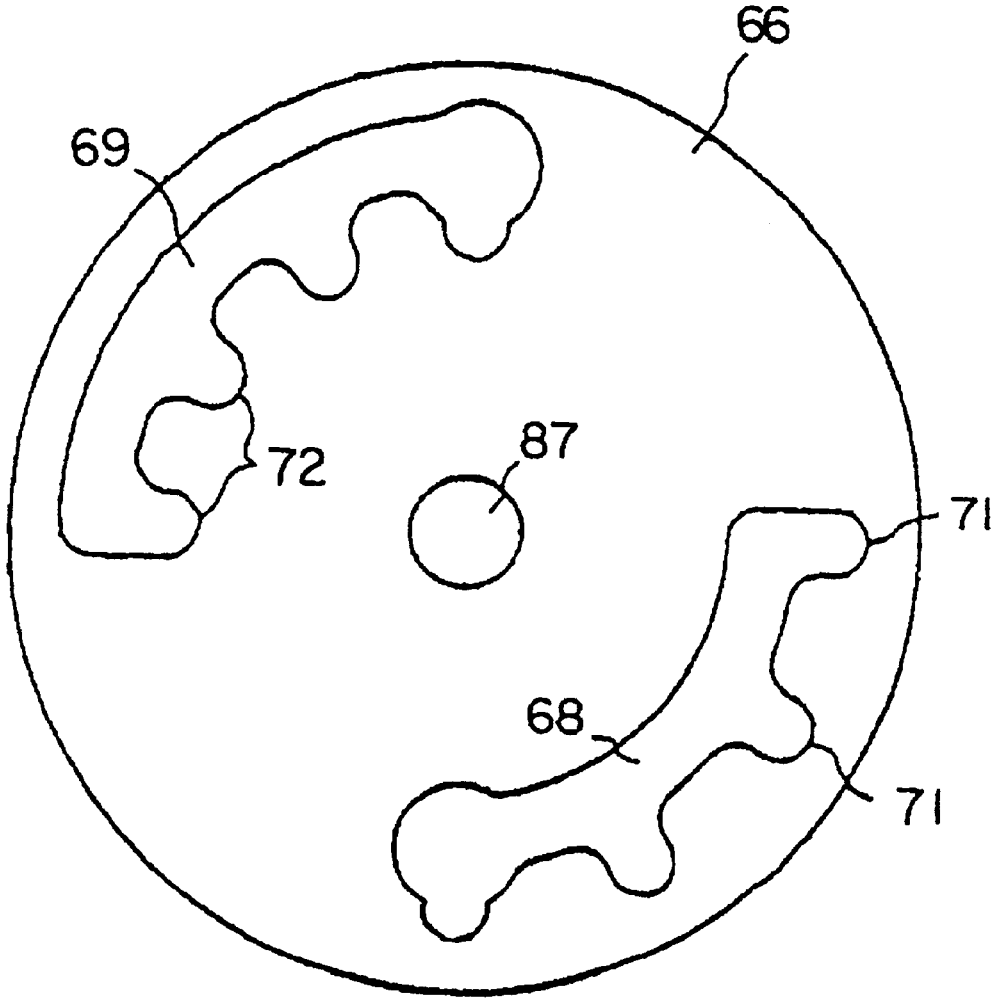
FIG. 9 is a side view showing an arrangement of the handle holding plate in an embodiment of the handle rotating mechanism according to this invention as an example of the position adjusting mechanism of the lever according to this invention.

As shown in FIG. 9, a plurality of first rotation regulating notches 71 (4 notches in FIG. 9) expanding outward in the radial direction is formed at predetermined intervals in the circumferential direction of the circumferential rim on the outside of the radial direction of said first rotation holding groove 68.

Whereas the same number of second rotation regulating notches 72 expanding inward in the radial direction as the first rotation regulating notches 71 are formed on the circumferential rim of the inside in the radial direction of said second rotation holding groove 69 and in a position facing each other and sandwiching the center axis of said handle holding plate 66 with respective first regulating notches 71.

Also, the respective fixing positions of the handle 4 are secured by the respective sets of the first and second rotation regulating grooves 71 and 72 positioned on the same line sandwiching the center axis A of said handle holding plate 66. For example, referring to FIG. 9, 4 sets of the first and second rotation regulating notches 71 and 72 are formed to therefore retain positions of the handle 4.

Referring back to FIG. 7 and FIG. 8, said handle 4 as a lever main body is, respectively, arranged independently on the outside of the axial direction of said respective handle holding plates 66.

Respective handles 20 have base portions 74 which are of a flat rectangular solid shape having extended lengths along the radial direction of said handle holding plate 66. The base portion 74 also grasps portion 75, whose cross-section is generally circular and bent inward, and is connected to a base end portion which is an end on the front side of the base portion 74 in FIG. 7.

Figure 10:
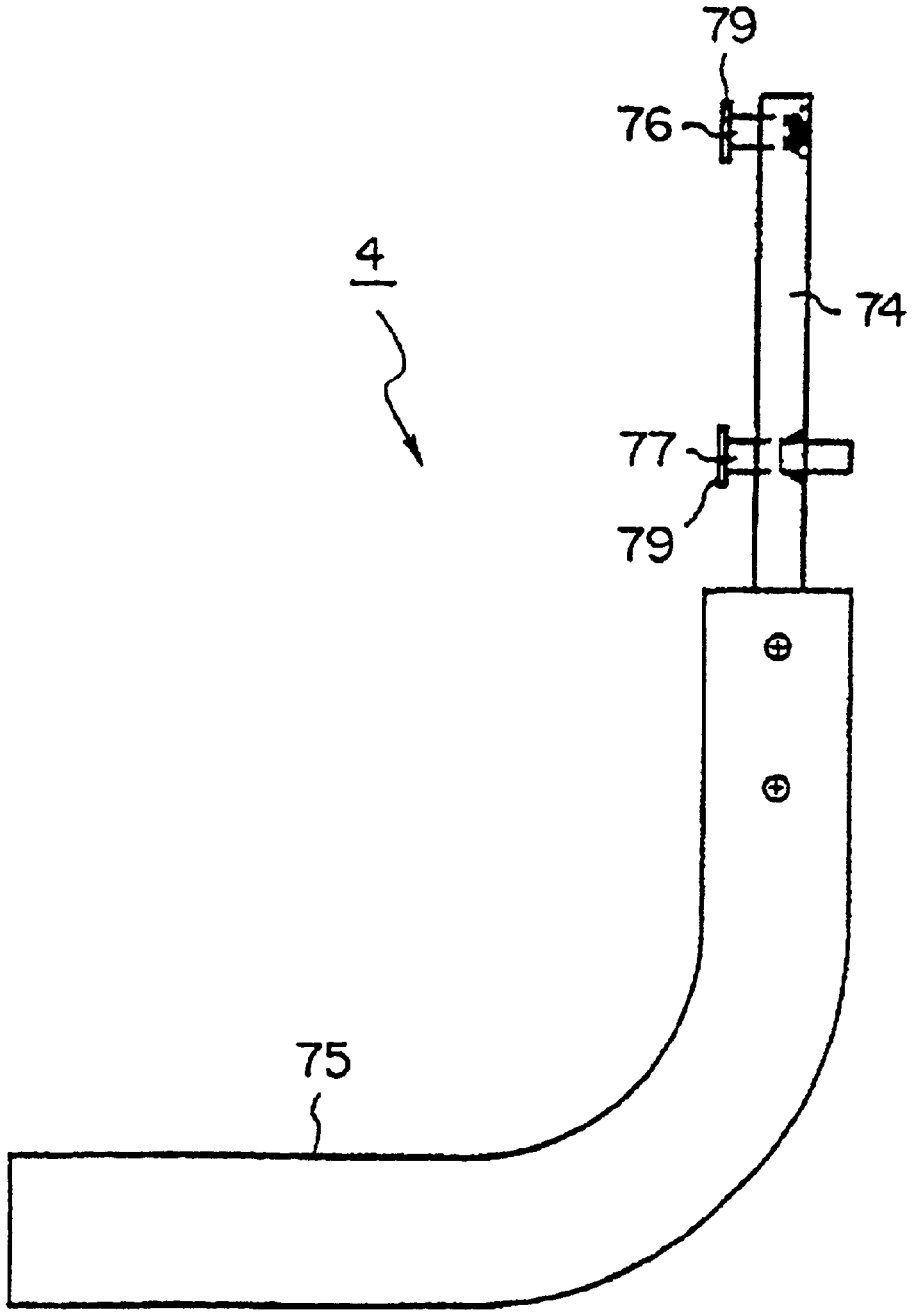
FIG. 10 is a view showing an arrangement of the handle base portion in an embodiment of the handle rotating mechanism according to this invention as an example of the position adjusting mechanism of the lever according to this invention.

As shown in FIG. 10, a pair of pins 76 and 77 in a bar shape are formed so as to protrude toward said holding plate 66 on the inner end face of said base portion 74, at positions corresponding to said first and second rotation holding grooves 68 and 69 (shown in FIG. 9), and the rotation of said handle 4 is maintained by the fact that this pair of pins 76 and 77 contact said both rotation holding grooves 68 and 69 in a sliding manner.

Said pair of pins 76 and 77 selectively fit into the respective set of said first and second rotation regulating notches 71 and 72, whereby the handle 4 can be fixed at respective fitting positions.

A disengagement preventing stopper 79, in a disk shape whose outer diameter is formed to be larger than the groove width of said rotation holding grooves 68 and 69, is formed to prevent said handle 4 from disengaging from said handle holding plate 66 at the ends of said pins 76 and 77, and the rotation of said base portion 74. As a result, position adjustment of said handle 4 can be stably carried out.

Figure 11:
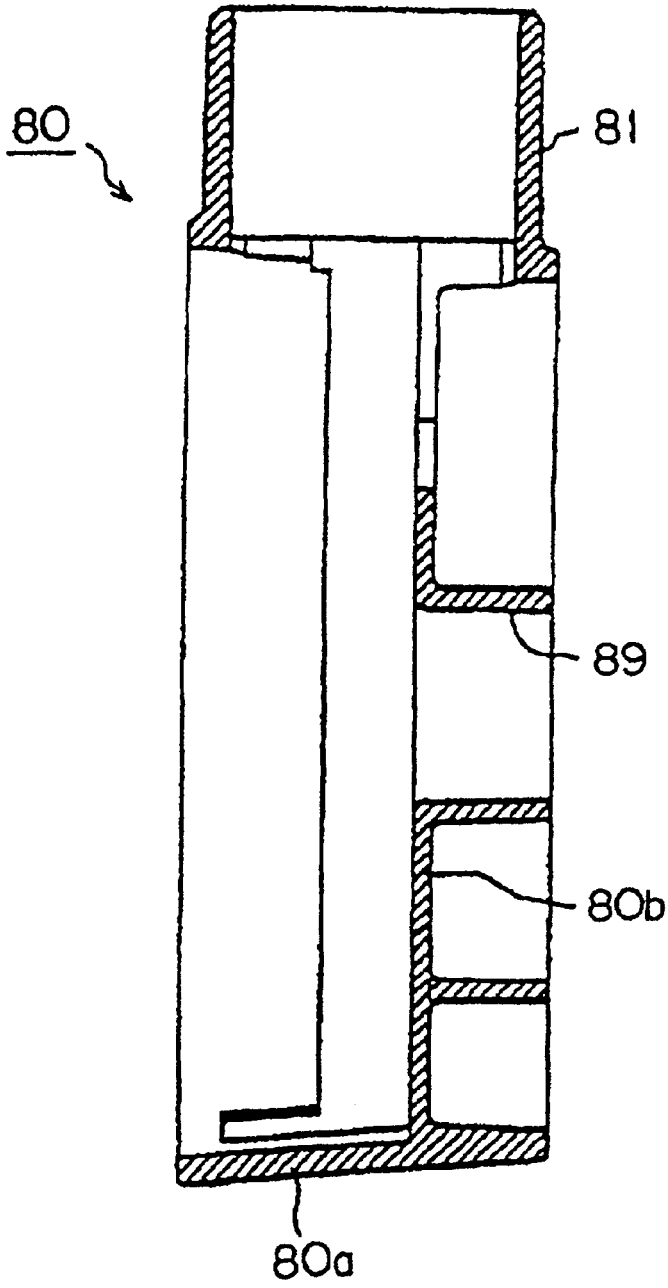
FIG. 11 is a cross-sectional view showing the handle cover in an embodiment of the handle rotating mechanism according to this invention as an example of the position adjusting mechanism of the lever according to this invention.
Figure 12:
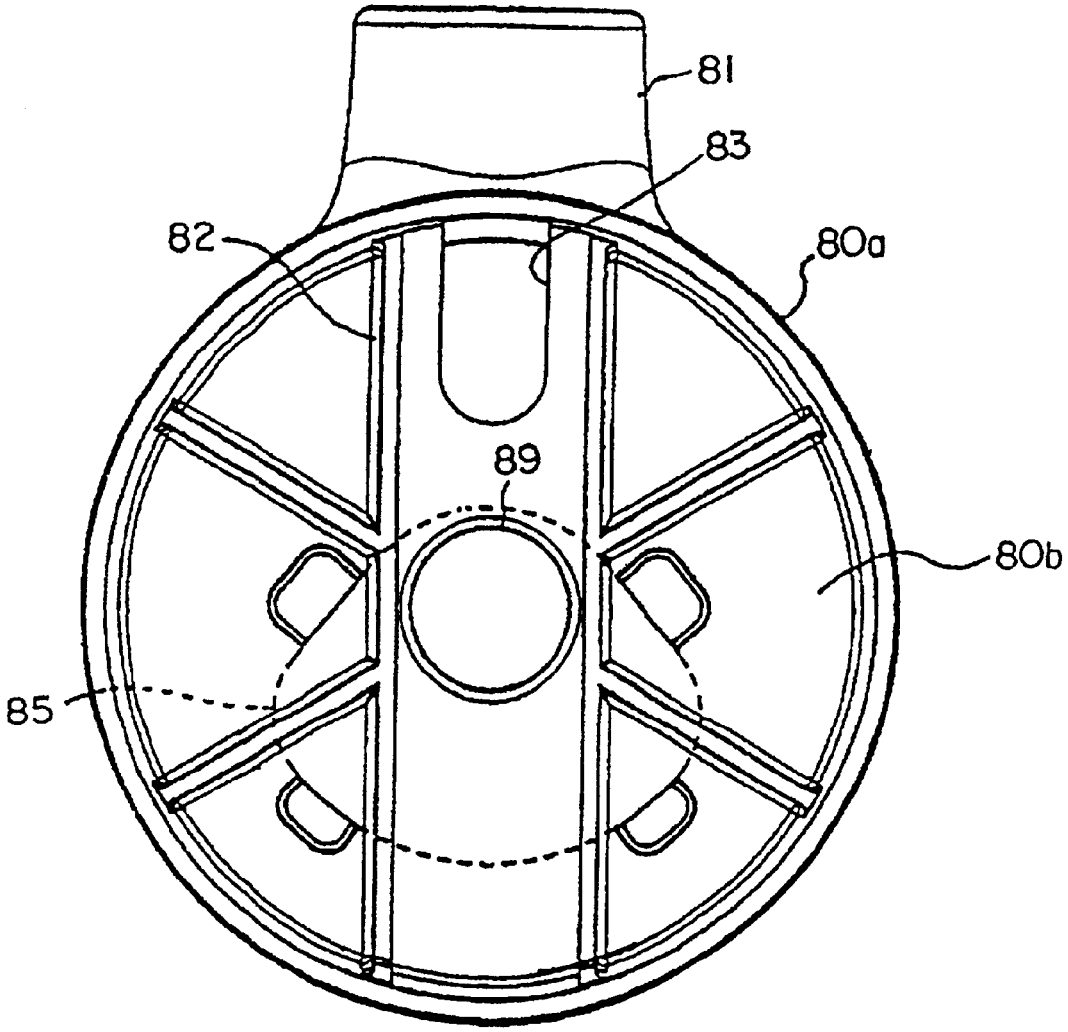
FIG. 12 is a view showing an arrangement of the inside in the axial direction of the handle cover in an embodiment of the handle rotating mechanism according to this invention as an example of the position adjusting mechanism of the lever according to this invention.
Figure 13:
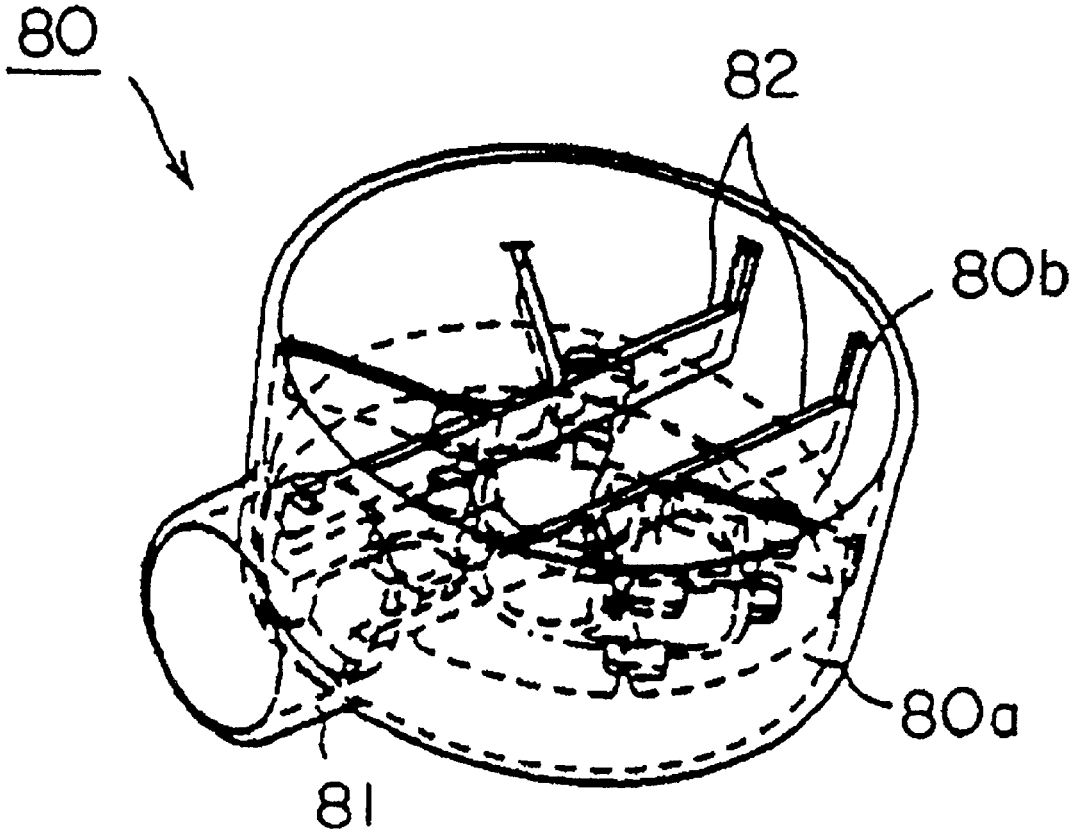
FIG. 13 is a perspective view showing the handle cover in an embodiment of the handle rotating mechanism according to this invention as an example of the position adjusting mechanism of the lever according to this invention.

At the outer circumference of said base portion 74, a handle cover 80 is arranged so as to enclose said base portion 74. As shown in FIG. 11 through FIG. 13, this handle cover 80 has side wall 80*a* which is of a generally disk shape and whose diameter is nearly the same as that of said handle holding plate 66, and at the outer circumference of this side wall 80*a*, a tubular outer circumferential wall portion 80*b* having a predetermined length along the axial direction of the rotating axis of the handle 4 is formed so as to surround said side wall 80*a*. On said outer circumferential wall portion 80*b*, a generally tubular guide portion 81 protrudes perpendicularly to said outer circumferential wall portion 80*b*, and via this guide portion 81, said base portion 74 is guided into the space enclosed by the inner face of said side wall portion 80*a* and said outer circumferential wall portion 80*b*. A pair of guide plates 82 are formed so as to hold both ends in the width direction of said base portion 74 while having a predetermined play on the inner side of said side wall portion 80*a*, and said base portion 74 is slidable along the radial direction of said handle holding plate 66 by this pair of guide plates 82.

In the vicinity of said guide portion 81 on said side wall portion 80*a*, the force applying notch 83 in a rectangular hole shape, which has long length along the longitudinal direction of said base portion 74, is bored. And, on the outer end face of said base portion 74 facing said force applying notch 83, a force applying pin 84 is formed so as to protrude toward said handle cover 80. The force applying pin 84 passes through said force applying notch 83 to the outside of said side wall portion 80*a*. Further, a fan shaped force applying member mounting portion 85 is formed on the outer face of said side wall 80*a*. A force applying member 86, such as a coil spring which is used as a means to apply force in the direction in which said base portion 74 is fitted into said first and second rotation regulating notches 71 and 72 by the pins 76 and 77. The force applying member is wound at the outer circumference of said force applying member mounting portion 85 and both ends of the force applying member 86 are fixed to said force applying pin 84.

Therefore, in a normal situation, via applied force of said force applying member 86, said base portion 74 can be held at the rotation regulation position according to said first and second rotation regulating notches 71 and 72.

On the other hand, by manually moving said base portion 74 in a direction to resist the applied force by said force applying member 86, fitting of said pins 76 and 77, and said first and second rotation regulating notches 71 and 72 are released and rotation of said base portion 74 is allowed. For this reason, the position of the handle 4 is easily and properly adjusted even during use of the apparatus.

Further, the handle rotating mechanism 62 is provided with a regulating means to regulate movement in a direction so as to resist the force applying direction of applied by said force applying member 86 by said handle 4 at any fixing position of the handle 4. This is done by said first and second rotation regulating notches 71 and 72.

Figure 14:
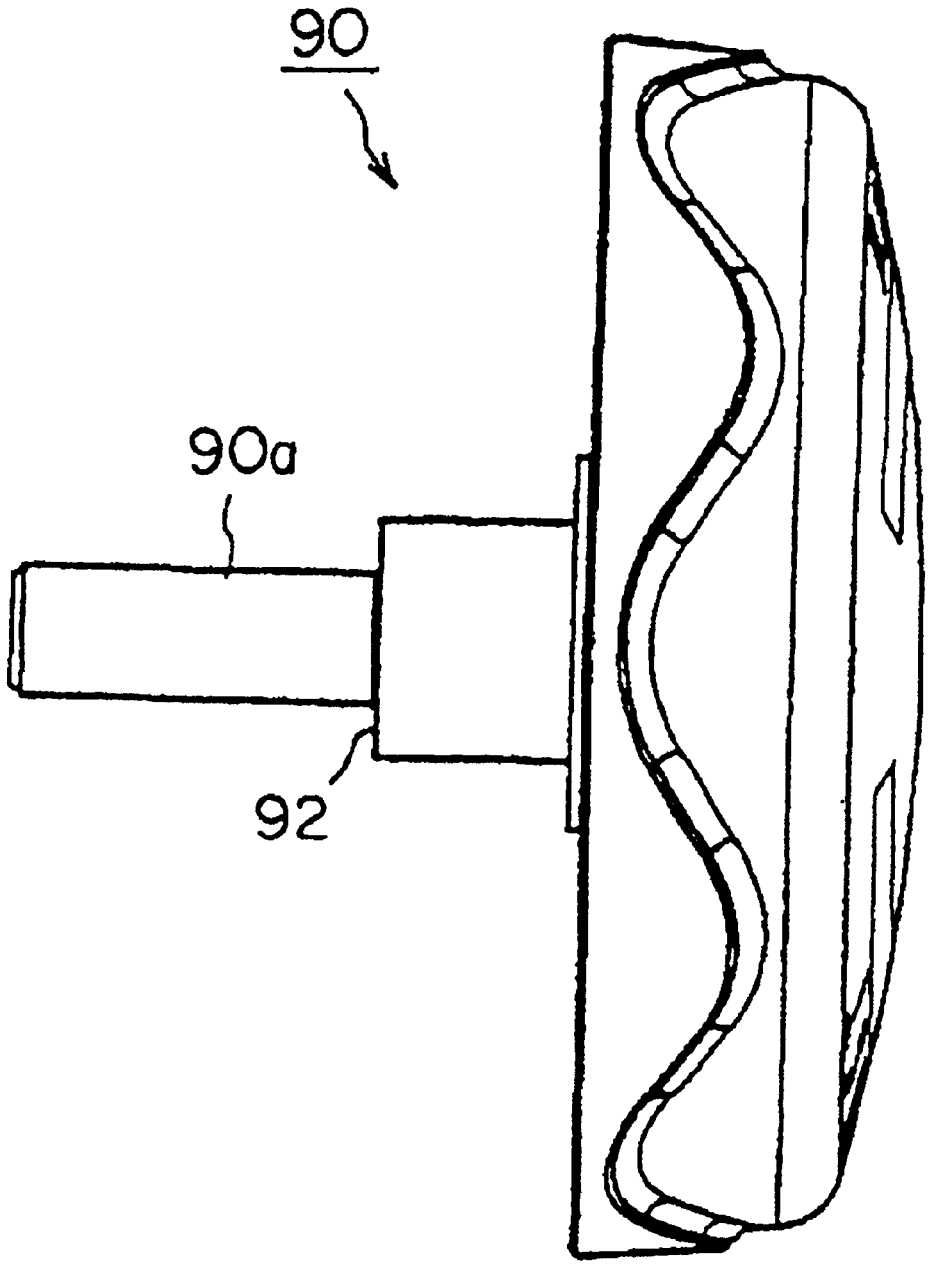
FIG. 14 is a view showing a fixing knob in an embodiment of the handle rotating mechanism according to this invention as an example of the position adjusting mechanism of the lever according to this invention.
Figure 15:
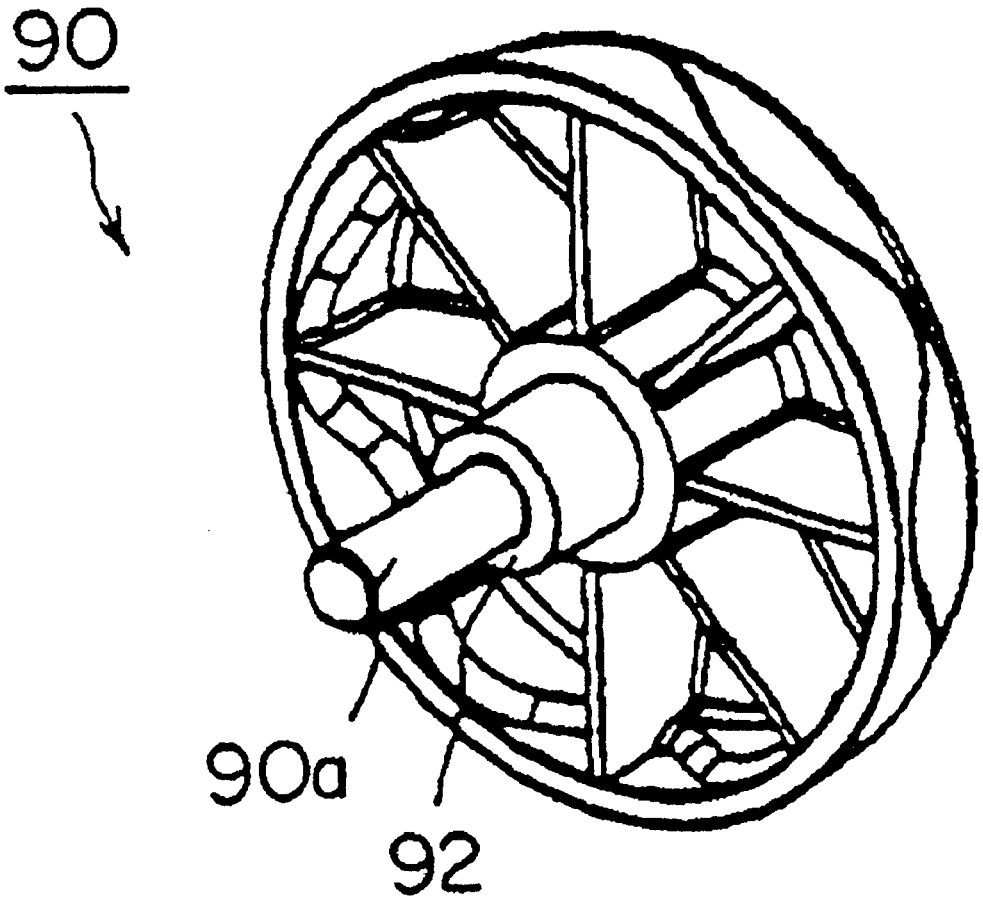
FIG. 15 is a perspective view showing a fixing knob in an embodiment of the handle rotating mechanism according to this invention as an example of the position adjusting mechanism of the lever according to this invention.

A circular hole 87 is bored in the middle part of said handle holding plate 66, and spiral female thread 87a is formed along the axial direction of the handle rotating axis. On the other hand, rectangular hole 88 having an extended length along the longitudinal direction of the base portion 74 is bored at the position corresponding to the forming position of said hole 87 of said handle holding plate 66 on said base portion 74. A circular penetrating hole 89 is bored at the middle, corresponding to the forming position of said hole 87 and said rectangular hole 88 on the side wall portion 80*a* of said handle cover 80. A fixing knob 90 shown in FIG. 14 and FIG. 15 is arranged on the outside of said handle cover 80, and on this fixing knob 90, male thread portion 90*a* having an extended length toward the inside of the axial direction is formed. Thus, this male thread portion 90*a* can be engaged with the female thread portion 87*a* of said handle holding plate 66 through said penetrating hole 89 and said rectangular hole 88. Therefore, this fixing knob 90 can be screwed into the inside in the axial direction which is the fastening direction by rotating said fixing knob 90. Furthermore, pressed portion 91 whose flat shape is nearly crescent is concavely formed into the inside of the axial direction at the end face on the outside of the axial direction of said base portion 74, as well as the position corresponding to the forming position of said rectangular hole 88.

A generally cylindrical pressing portion 92 whose outer circumference is formed slightly smaller than that of said pressed portion 91 is provided on the base end portion of said male thread portion 90*a* corresponding to said pressed portion 91. This pressing portion 92 can press said pressed portion 91 by screwing inside in accordance with the fastening movement of said fixing knob 90. For this reason, said base portion 74 can be fixed at a predetermined position only by rotating said fixing knob 90 in the fastening direction.

Therefore, said regulating means allows said handle 4 to be easily and properly fixed at the fixing position.

In addition, said male thread 90*a* penetrates the base portion 74 through said rectangular hole 88. Except for the time when the handle 4 is fixed by said fixing knob 90, movement in the radial direction is not obstructed by said male thread portion 90*a* because said rectangular hole 88 is formed so as to have play in the longitudinal direction of the base portion 74 against said male thread portion 90*a*.

Next, operation of the embodiment will be described.

At first, in the initial state, said base portion 74 is assumed to have force-applied thereto by means of the force applying member 86 at a fixing position where a predetermined set of a pair of pins 76 and 77, and said first and second rotation regulating notches 71 and 72 are fitted. Further, at this time, the pressed portion 91 of said base portion 74 is in a state where it is pressed by the pressing portion 92 of said fixing knob 90. Accordingly, manual movement of said handle 4 is regulated.

When changing the position of said handle 4 from the initial state, the pressing of the pressed portion 91 of said base portion 74 by the pressing portion 92 of said fixing knob 90 is released by rotating said fixing knob 90 in the reverse direction to the fastening direction. This allows said base portion 74 to be placed in a state where only the applied force of the force applying member 86 works. Therefore, manual movement of the base portion 74 is allowed.

Next, referring to FIG. 7, said handle 4 is pulled toward the front to resist the applied force of said force applying member 86. This allows the pair of pins 76 and 77 formed at said base portion 74 to be respectively released from fitting to said first and second rotation regulating notches 71 and 72. This allows said base portion 74 to carry out the predetermined rotation while contacting said respective pins 76 and 77 with said first or second rotation holding grooves 68 and 69 in a sliding manner.

After rotating said base portion 74 and moving said base portion 74 to the predetermined fixing point, that is, this forms the position of the other set of the first and second rotation regulating notches 71 and 72. The pins 76 and 77 of said base portion 74 are, by means of applied force by force applying member 86, fitted into the rotation regulating position by the applicable other first and second rotation regulating notches 71 and 72. This is done by releasing said handle 4, which allows said base portion 74 to be regulated again.

After the base portion 74 is regulated, the pressed portion 91 of said base portion 74 is pressed with the pressing portion 92 of said fixing knob 90 by rotating said fixing knob 90 in the fastening direction. This allows manual movement of said base portion 74 to be regulated, and said handle 4 is fixed to a new fixing position. At this time, fixing the position of the handle 4 is easily and rapidly carried out only by rotation of the fixing knob 90.

The conventionally employed handle of the training apparatus was formed by integrally coupling the right and left grasping portions with the connecting shaft. In addition, by inserting said connecting shaft into the annular rotation supporting portion horizontally mounted on the top end of the handle post, said handle was rotatable around the axial direction of the rotation supporting portion. Furthermore, on the connecting shaft, the outer circumference of the fixed portion of the connecting shaft is formed polygon. On the outside of said rotation supporting portion corresponding to this fixed portion, the lock knob which can be screwed into the rotation supporting portion by rotating movement and against which said pressed portion can be pressed, was installed. Therefore, when disassembling and inspecting the handle, there existed a problem in that disassembly and inspection could not be generally carried out unless the exterior cover and control device located on the outside of the lock knob were removed. Further, when using the training apparatus, torsional torque was generated on the handle itself by the load applied on the grasping portion of the handle. Conventionally, this torque had to be received by said fixed portion of the handle. However, this fixed portion did not have necessary and sufficient forming range due to limitations of space in the vicinity of the center of the handle. Therefore, looseness and rattling of the handle were generated at the fixed portion, or, in order to prevent them, the lock knob had to be tightened with large force, and there existed a problem in that operability for the user was impaired.

However, in said handle rotating mechanism 62, the right and left of said handle 4 are individually installed to the handle post 3 differently from the conventional one. Said handle 4 can be easily removed from the handle holding plates 66 and 67 via notches 68*a* and 69*a* formed on said first and second rotation holding grooves 68 and 69. Therefore, disassembly and inspection efficiency can be enhanced. According to said handle rotating mechanism 62, changing the position of the handle 4 can be easily and properly carried out only by moving said handle 4 in a direction to resist the force applying direction by said force applying member 86. In addition, fixing of the handle 4 to a new handle position can be stably and securely carried out by said regulating means.

In particular, the position of said handle 4 can be adjusted while riding the apparatus; therefore, operability of the apparatus can be enhanced.

Additionally, in the above embodiment, said first rotation regulating notch 71 is formed at the circumference of the outside of the radial direction of said first rotation holding groove 68, and said second rotation regulating notch 72 is formed at the circumference of the inside of the radial direction of said second rotation holding groove 69. However, there is no need to limit the modes of construction only to these. That is, for example, said first rotation regulating notch 71 may be formed so as to expand toward the inside of the radial direction at the circumference of the inside of the radial direction of said first rotation holding groove 68. Said second rotation regulating notch 72 may be formed so as to expand toward the outside of the radial direction at the circumference of the outside of the radial direction of said second rotation holding groove 69.

In such a case, if the force applying direction by said force applying member 86 is placed in the reverse direction in said embodiment, and the moving direction of the handle 4 to release regulation of rotation by the first and second rotation regulating notches 71 and 72 is placed in the reverse direction in said embodiment, and the handle 4 is pushed forward in FIG. 7, then the same action and effectiveness as those in the embodiment can be obtained.

Inside said handle post 3 and said lower frame 9, tube 106 having an extended length upward and downward for the supporting handle is arranged. Inside said tube 106, the connecting structure of the tube 106 is provided. That is, said tube 106 can be separated into the inserting side tube 101 and the inserted side tube 102 becomes a boundary of separating line A shown in FIG. 1.

Figure 16:
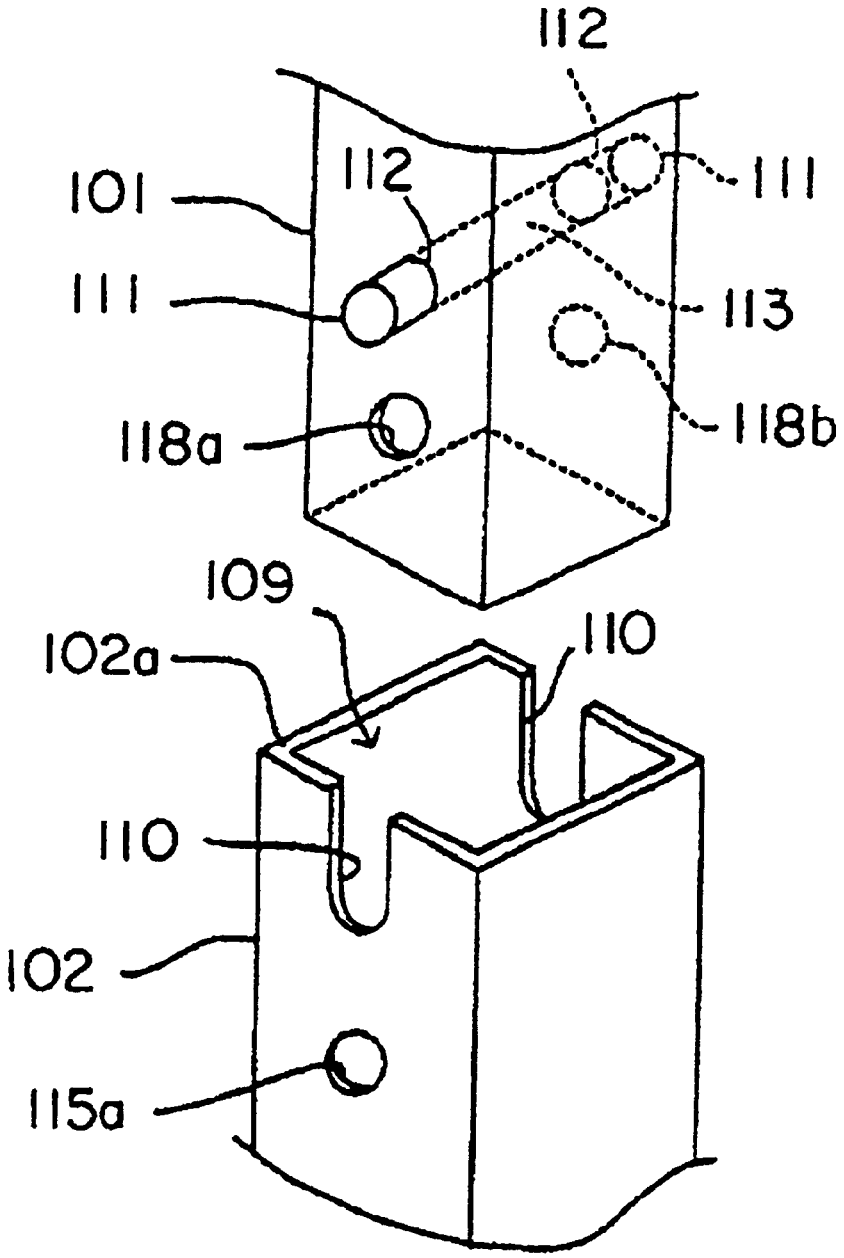
FIG. 16 is a perspective view showing the separating state before connecting the inserted side tube and inserting side tube in the connecting structure according to this invention.

Said inserting side tube 101 is formed to be of a tubular shape having an extended length upward and downward whose cross section is generally square. Said inserted side tube 102 is formed to have opening 109 whose outer circumference is formed to be larger than that of said inserting side tube 101 and is of a tubular shape having an extended length upward and downward. For this reason, when assembling, said inserting side tube 101 can be inserted into said inserted side tube 102 via said opening 109 from the upper part in FIG. 16.

In this embodiment, notch 110 is concavely formed downward and the position is aligned when connecting both tubes 101 and 102. Further, in this embodiment, said pair of notches 110 are formed on two sides facing each other among said top faces 102*a*. However, there is no need to limit the modes of construction of the invention to this because they may be formed on only one side or on three or more sides.

On the other hand, the same number of projections 111 as that of said notches 110 are formed so as to abut against notches 110 for aligning positions with the notches 110 when connecting both tubes 101 and 102 at the outer circumference of said inserting side tube 101 and at the position corresponding to said notches 110 in the circumferential direction.

Therefore, an alignment for connecting both tubes 101 and 102 can be easily carried out by inserting said inserting side tube 101 into the inserted side tube 102 and abutting said projections 111 against said notches 110.

Further, in this embodiment, said projections 111 are easily formed by forming a pair of holes 112 at the position where the outer circumferential walls of said inserting side tube 101 are facing each other, and penetrating a cylindrical pin 113 from one outer circumferential wall to the other outer circumferential wall facing opposite through this hole 112.

Figure 17:
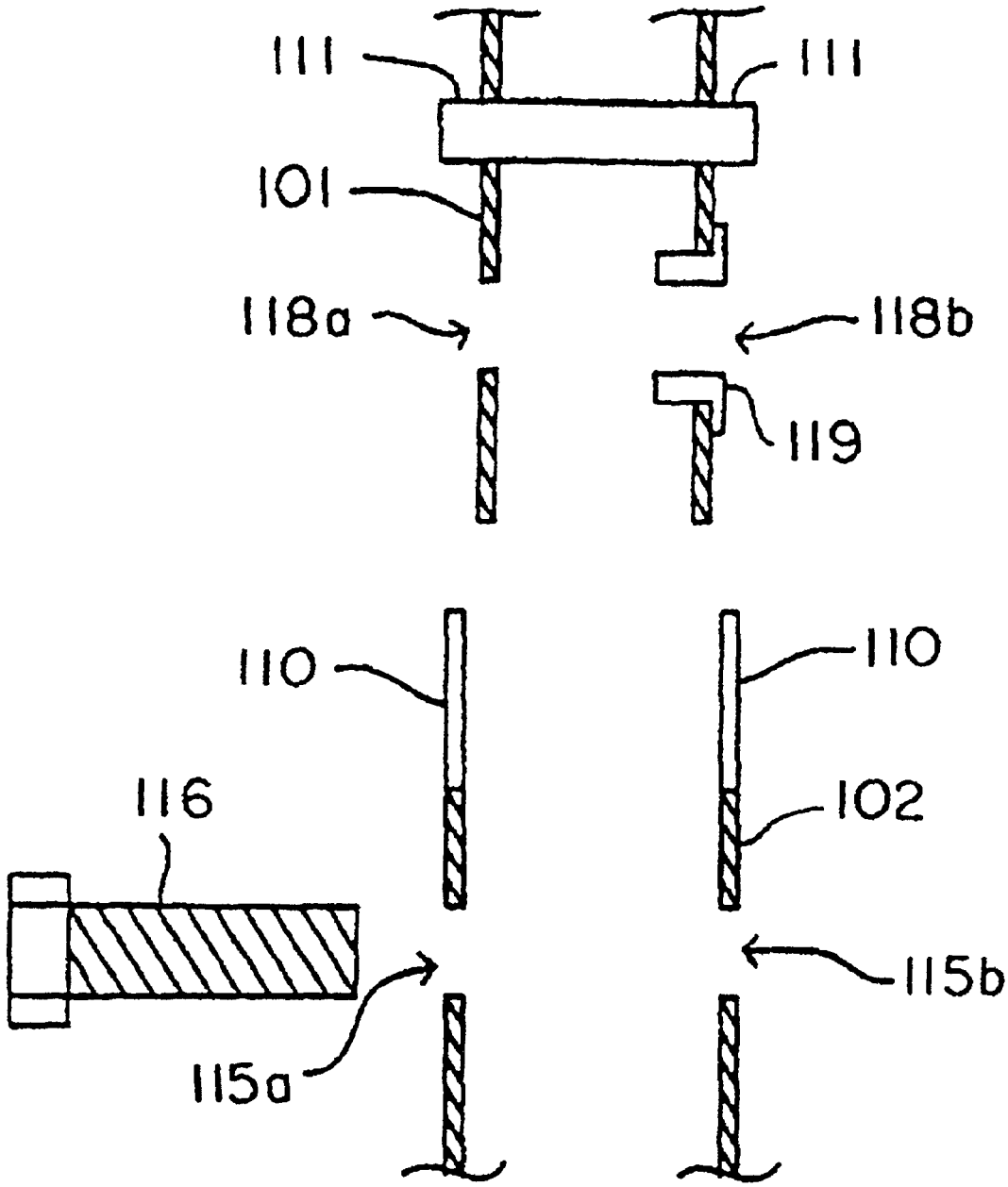
FIG. 17 is a cross-sectional view showing a separating state before connecting the inserted side tube and inserting side tube in a connecting structure according to this invention.

A pair of inserted side connecting holes 115*a* and 115*b* for connecting both tubes 101 and 102 is formed on said inserted side tube 102 which is on the lower position of said pair of notches 110. Connection of both tubes 101 and 102 can be carried out by fastening members 116 such as bolts through the inserted through the side connecting hole 115*a* from outside of the inserted side tube 102. That is, on the outside of said inserted side tube 102, said fastening member 116 is arranged so as to be inserted into the inside direction of the inserted side tube 102 orthogonal to the inserting direction of said inserting tube 101 via said inserted side tube connecting hole 115*a*. Further, as shown in FIG. 17, a pair of inserting side connecting holes 118*a* and 118*b* are formed at the position corresponding to said inserted side connecting holes 115*a* and 115*b* in a connecting state on the outer circumferential wall of said inserting side tube 101. Fastened member 119, such as, for example, a nut for connecting both tubes 101 and 102 with said fastening member 116 is arranged so as to screw the fastening member 116 into the fastened member 119 at the outer circumference of one of the inserting side connecting holes 118*b* which is on the front side of the inserting direction of the fastening member 116.

For this reason, with screwing said fastening member 116 into said fastened member 119, the fastening member 116 can be screwed into the inside of the inserted side tube 102 orthogonal to the inserting direction of said inserting side tube 101. Therefore, both tubes 101 and 102 can be fastened from the direction orthogonal to the inserting direction of said inserting side tube 101.

Next, operation of the connection structure of said tube 106 will be described.

At first, in the initial state, said tube 106 is assumed to be divided into the inserting side tube 101 and inserted side tube 102.

When connecting both tubes 101 and 102 from the initial state, said inserting side tube 101 is inserted into the inside of the inserted side tube 102 from above.

At this time, projection 111 is formed on said inserting side tube 101, and said notch 110 is formed on the top face 102*a* of the inserted side tube 102 so as to correspond to the forming position of this projection 111; therefore, said projection 111 abuts against said notch 110 after inserting a predetermined length of said inserting side tube 101 into said inserted side tube 102. Depending on the connecting dimensions, inserting the inserting side tube 101 into the inserted tube 102 longer than this length is prevented.

Figure 18:
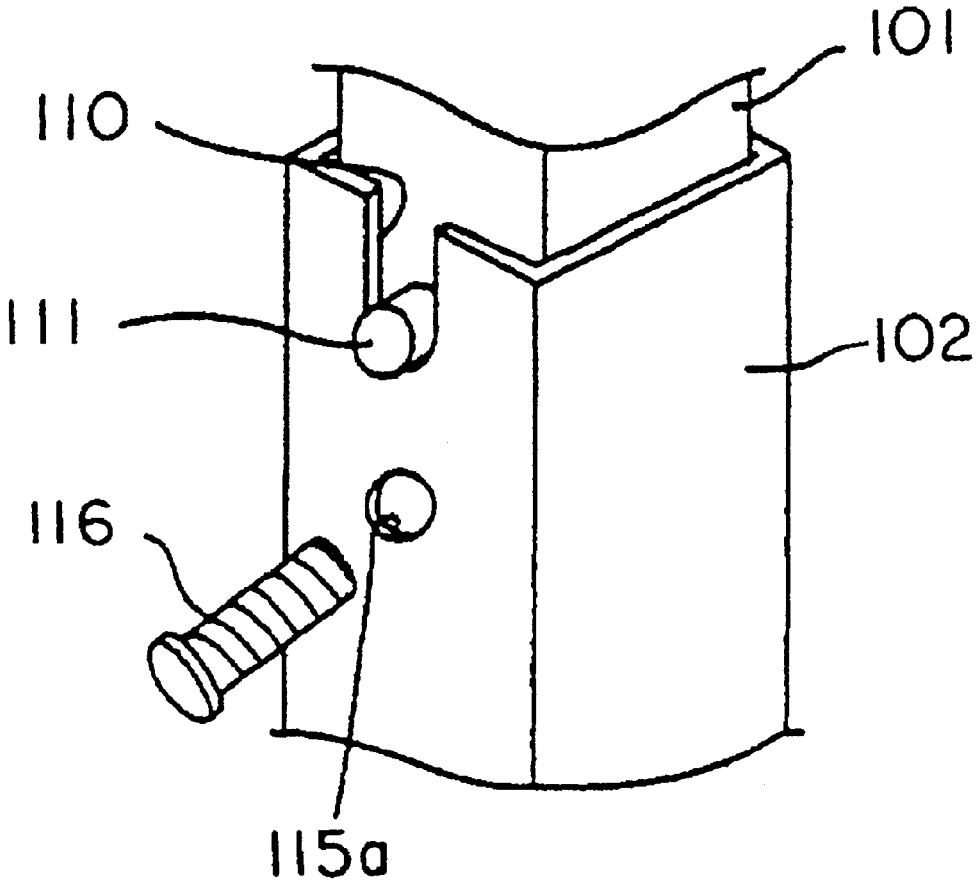
FIG. 18 is a perspective view showing alignment completing state for the connecting inserted side tube and inserting side tube in the connecting structure according to this invention.

Said inserted side connecting holes 115*a* and 115*b*, and inserting side connecting holes 118*a* and 118*b* are positioned on the same line on the abutting position to said notch 110 by said projection 111; therefore, connection of both tubes 101 and 102 by the fastening member 116 is allowed. Thereby, as shown in FIG. 18, alignment for connecting both tubes 101 and 102 is completed.

After alignment has been completed, the top end of the fastening member 116 is screwed into said fastened member 119 which is arranged on said inserting side tube 101 after said fastening member 116 is inserted into the inside of the inserted side tube 102 via said inserted side connecting hole 115*a* from the outside of said inserted side tube 102. Said inserting side tube 101 is passed through said inserting side connecting hole 118*a* during insertion.

In a state where the top end of said fastening member 116 is screwed into the fastened member 119, said fastening member 116 is screwed toward the inside of the inserted side tube 102 orthogonal to the inserting direction of said inserting side tube 101 by rotating the fastening member 116 in the fastening direction (in a case of a right thread, clockwise around the axis of said fastening member 116).

At this time, alignment of the inserting direction of the inserting side tube 101 is properly carried out by abutting said notch 110 against said projection 111. Therefore, connecting work with the fastening member 116 can be easily and properly carried out.

In a state where the connecting position is stably held by said projection 111 and said notch 110, both tubes 101 and 102 are connected so that the outer circumference of the inserting side tube 101 and the inner circumference of the outer tube 102 press against each other by said fastening member 116 and said fastened member 119. Therefore, the tubes 101 and 102 can be solidly connected while preventing shifting and rattling in a direction orthogonal to the upward and downward direction which is the connection direction in FIG. 1.

Figure 19:
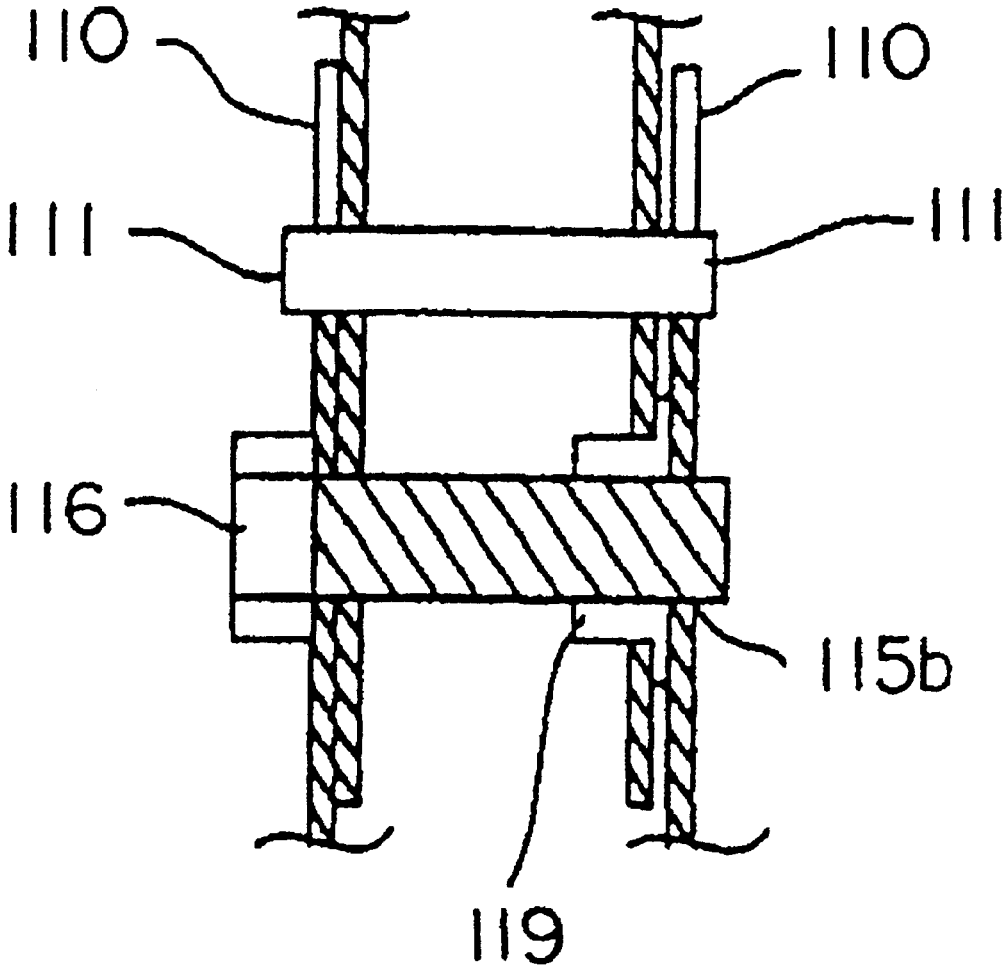
FIG. 19 is a cross-sectional view showing the inserted side tube and inserting side tube in a connecting structure according to this invention.

Further, the inserting direction top end side of said fastening member 116 penetrates into the outside of the inserted side tube 102 through the inserted side connecting hole 115*b* on the front side of the inserting direction formed on said inserted side tube 102 after passing through said fastened member 119. Therefore, both connected tubes 101 and 102 can make full use of the resistance against the pulling force in the connecting direction. Thereby, as shown in FIG. 19, connecting work for both tubes by fastening member 116 is completed.

In the conventionally employed connecting structure for tubes, there existed a requirement to largely form a difference in the dimensions of the outer circumference between both tubes in order to connect both tubes smoothly. However, in this case, one tube whose outer circumference is small can be easily inserted into the other tube whose outer circumference is large, but there existed a problem in that alignment was difficult when connecting. On the other hand, if a difference in the dimensions of the outer circumference between both tubes is small, as in this case, there still was a problem in that connection was not smoothly carried out.

However, according to the connecting structure of said tubes 106 of the present invention alignment of tubes 101 and 102 when connecting can be easily carried out by abutting the projection 111 against the notch 110. Therefore, in view of alignment, there is no need to reduce the difference in the dimensions of the outer circumference of both tubes 101 and 102 any more than is necessary, and the inserting side tube 101 can be easily inserted into the inserted side tube 102. Further, since alignment of both tubes 101 and 102 when connecting can be stably maintained by abutting the projection 111 against the notch 110, connection with precise connecting dimension can be stably and solidly carried out while preventing rattling when connecting. Further, since a stable connection can be realized by a simple construction comprising the notch 110 and projection 111, production costs can be reduced.

In particular, as shown in the training apparatus 1, when applying the invention to the case where the connecting position cannot be visually viewed because the outer circumference of the tube 106 has to be covered with the handle post 3 and lower frame 9 in view of the exterior, and where the user needs to connect the tubes 101 and 102 after purchasing, an apparatus which is easily assembled and has excellent use is provided.

In addition, this invention is not limited to the above-described embodiments, and it is possible to change to various forms as necessary. In addition, this invention is not limited to the above-described embodiments, and it is possible to change modes of construction of the invention to various forms as necessary.

For example, the cross-sectional shape of said both tubes 101 and 102 may be formed to be of desired ones according to the design concept However, it is preferable that said tubes 101 and 102 are formed to be, for example, of a shape having an even number of edges such as a regular hexagon since said projection 111 is easily formed by penetrating the pin 113 into the pair of outer circumference wall portions of the inserting side tube 101 facing each other.

Further, in said embodiments, said inserting side tube 101 is formed to be cylindrically hollow; however, there is no need to limit the modes of construction of the invention to this. For example, said inserting side tube 101 may be formed to be solid.

What is claimed is:

1. A training apparatus comprising a main body frame, a saddle post provided on said main body frame with a space provided between said main body frame and said saddle post, an annular drive transmission member provided on a crank shaft connected to a pedal, a running type drive transmission member wound around said annular drive transmission member and said annular drive transmitted member, is further provided on a shaft of a loading device comprising a rotor and stator, wherein, a pair of supporting plates are fixed to said main body frame, and one of said pair of supporting plates is smaller than another one of said pair of supporting plates, only said smaller one of the supporting plates can pass through said space defined by said main body frame and said saddle post, and said larger one of said support plates cannot pass through said space, and said crank shaft and said shaft of the loading device are supported by at least one of said pair of supporting plates.

2. The training apparatus according to claim 1, wherein, said annular drive transmission member is provided adjacent to and between the supporting plate which cannot pass through said space and said loading device.

* * * * *